United States Patent [19]

Caron

[11] Patent Number: 4,759,202

[45] Date of Patent: Jul. 26, 1988

[54] LAUNDRY WASHING MACHINE WITH A DUAL WASHING-AGENT DISPENSER

[75] Inventor: Edith M. Caron, Amiens, France

[73] Assignee: U.S. Philips Corporation, New York, N.Y.

[21] Appl. No.: 799,527

[22] Filed: Nov. 19, 1985

[30] Foreign Application Priority Data

Nov. 30, 1984 [FR] France ..... 8418287

[51] Int. Cl.[4] ..... D06F 39/02

[52] U.S. Cl. ..... 68/17 R

[58] Field of Search ..... 68/17 R, 207; 134/93

[56] References Cited

U.S. PATENT DOCUMENTS 2,699,886 1/1955 James, Jr. ..... 68/17 R X

FOREIGN PATENT DOCUMENTS 128070 12/1984 European Pat. Off. ..... 68/17 R
128073 12/1984 European Pat. Off. ..... 68/17 R
2401259 4/1979 France ..... 68/17 R
2503744 10/1982 France ..... 68/17 R
39664 4/1978 Japan ..... 68/17 R

*Primary Examiner*—Philip R. Coe
*Attorney, Agent, or Firm*—Ernestine C. Bartlett

[57] ABSTRACT

A top-loading washing machine comprises a tub door formed in the top wall of the machine and pivotal between a vertical open position and a horizontal closed position. A longitudinally extending washing agent dispenser is provided in the tub door and has an aperture at one end for the introduction thereinto of either a liquid washing agent or a washing powder when the tub door is in its vertical position. A liquid compartment is positioned at the opposite end of the dispenser and is separated from an adjacent powder compartment by a partition, the partition being provided with openings for the passage into the liquid compartment of liquid washing agent introduced into the dispenser and being formed to retain washing powder introduced into the dispenser. An opening is located in the inner wall of the dispenser adjacent the washing agent introduction aperture for dispensing of washing powder or liquid washing agent into the washing machine tub when the tub door is in its horizontal position. A conduit is provided for supplying water under pressure into the liquid compartment for mixing with any liquid washing agent therein or for entraining any washing powder in the powder compartment for dispensing the same in the horizontal position of the tub door.

4 Claims, 4 Drawing Sheets

LAUNDRY WASHING MACHINE WITH A DUAL WASHING-AGENT DISPENSER

BACKGROUND OF THE INVENTION

This invention relates to a laundry-washing machine of the top-loading type, having at least one washing-agent dispenser formed in the pivotal tub door which extends horizontally in its closed position. The dispenser comprises two compartments, each intended for either a liquid or a powder, and a conduit by means of which a programmed water supply to the compartments is possible when the door is in its closed position. The liquid washing agent is discharged into the tub of the washing machine in part by siphoning and the washing powder is discharged by entrainment. The compartments can be filled when the door is in its open vertical position. Such a machine is known, for example, from French Patent No. 2,503,744. With such a machine the user is given the possibility of using either a washing powder or a liquid washing agent, as preferred.

French Patent No. 2,503,744 aims at providing a machine equipped with a washing-agent receptacle and dispenser having at least two compartments for the washing cycle, of which one compartment is intended for a liquid washing agent and the other compartment is intended for a washing powder. The two compartments are situated side by side and each has a filling aperture. The washing-agent dispenser has a single water-supply conduit for the simultaneous supply of water to both compartments.

Such a machine has some drawbacks. Washing machines having programs including a washing cycle and a prewashing cycle are required to have a dispenser with four compartments to provide a choice between washing powder and liquid washing agent for the washing and prewashing cycles. However, only two of these compartments are in use at the same time, which means that unnecessary space is occupied in the width direction of the tub door, which should accommodate two further compartments intended for other products, such as for example a fabric softener and a bleach.

Apart from the space they occupy the compartments have individual filling apertures. Therefore, it is not unlikely that the functions of the compartments may be interchanged and, for example, a liquid washing agent may be poured into the washing powder compartment. As a result of this, concentrated liquid washing agent will be discharged directly into the tub of the washing machine. Conversely, if a washing powder is put into the liquid washing agent compartment the siphon of the liquid compartment will be obstructed by the washing powder.

SUMMARY OF THE INVENTION

It is the object of the present invention to provide a laundry-washing machine whose dispenser has a small width and can be used regardless of whether the washing agent is a liquid or a powder. According to the invention the washing machine is characterized in that the two compartments of the dispenser have a common filling aperture, the powder compartment being disposed above the liquid compartment when the door is in the open position. A partition between the compartments ensures that the powder is retained but allows the passage of the liquid.

In French Patent No. 2,503,744 the watersupply conduit is common to the two compartments, the conduit providing a simultaneous supply to said compartments. Thus, the water supplied is divided between two compartments, which has an adverse effect on the correct water supply to the compartments.

In order to solve this problem, in accordance with a preferred embodiment of the invention, the partition comprises a water-supply means adapted to lead the water contained in the liquid compartment towards the powder compartment when the door is in the closed position. In this way the liquid compartment and the powder compartment are supplied in series with a single discharge of water.

The water supply means which ensures that the contents of the liquid compartment is transferred to the powder department may be a siphon which bridges the partition to siphon the water from the liquid compartment into the powder compartment. In accordance with the invention the partition between the compartments may be designed in different ways, for example using two superimposed plates formed with a plurality of holes in such a way that the holes in the two plates are not in register, or using a mesh screen whose meshes are dimensioned to allow the passage of a liquid and to retain a powder.

In a preferred embodiment of the invention the partition separating the two compartments of the dispenser is a baffle means comprising at least two baffle plates which extend substantially vertically when the door is in the closed position, so that one of said plates then constitutes an imperforate wall for the liquid compartment. The baffle means is arranged in the central part of the dispenser above the maximum level of the liquid washing agent in the liquid compartment when the door is in its vertical position. When this type of partition is employed the water from the liquid compartment can be discharged in two ways. The first is to provide a passage which communicates with the powder compartment and which opens into the upper part of this compartment when the door is in the closed position and the powder is discharged in that it streams out. However, preferably the baffle means has a passage which communicates with the powder compartment and which opens into the lower part of this compartment when the door is in the closed position. The powder is then discharged by a broad stream of water which flows into the lower part of the powder compartment.

DESCRIPTION OF THE DRAWINGS

The invention will now be described in more detail, with reference to the accompanying drawings, in which.

DESCRIPTION OF THE PREFERRED EMBODIMENT

Figure 1:
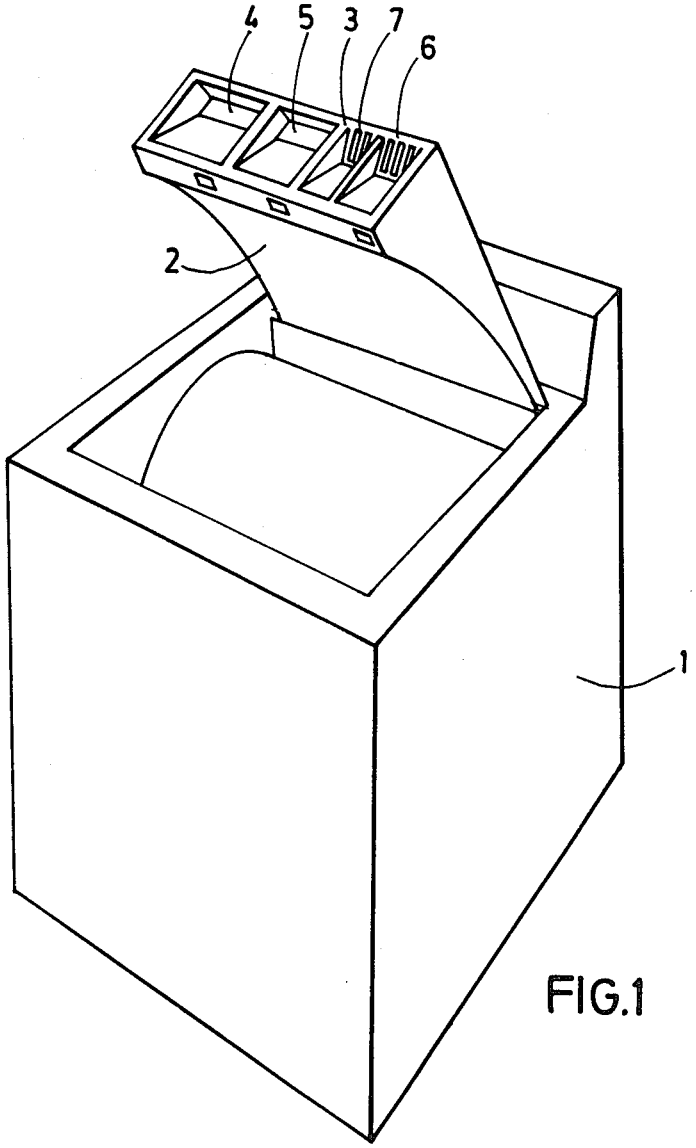
FIG. 1 shows the laundry-washing machine in accordance with the invention with the tub door in a halfopen position.

FIG. 1 shows a laundry-washing machine 1 of the top-loading type in accordance with the invention with its door 2 in a half-open position, which door is pivotal about a horizontal axis 24. The door includes a plurality of longitudinally extending washing-agent dispensers. The front wall 3 of the door is formed with filling apertures 4 and 5 for the washing and prewashing dispensers intended for washing agents in liquid form and in powder form. The two other apertures 6 and 7 are those of the compartments intended for laundry conditioners, such as for example fabric softeners and bleaching agents.

Figure 2:
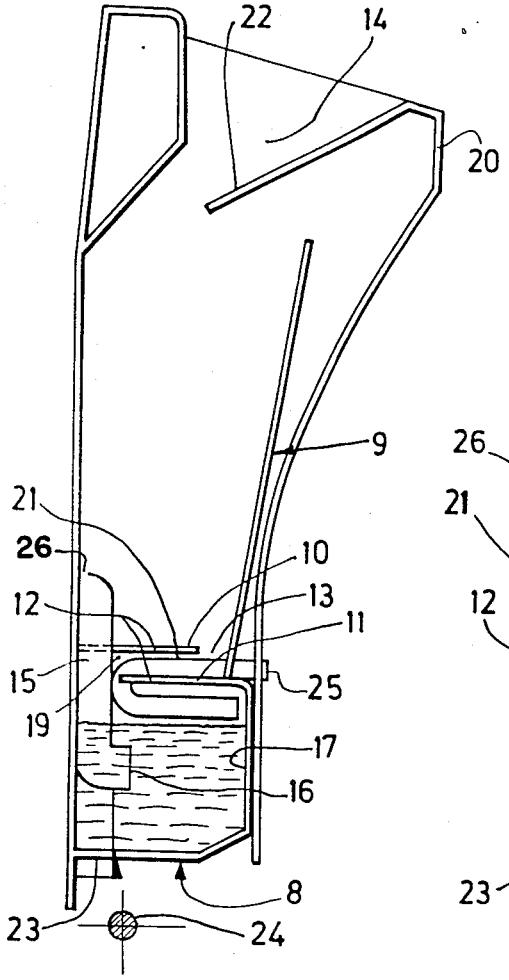
FIG. 2 is a longitudinal sectional view of the washing-agent dispenser filled with a liquid washing agent in the vertical position.

The dispenser as shown in FIG. 2 has substantially the shape of a truncated pyramid and occupies part of the space between the plane external surface of the door and the cylindrical surface of the drum of the tub. The dispenser includes a liquid compartment 8 situated at the lower part when the door is in the open position and a powder compartment 9 situated above the liquid compartment. The separation between the powder compartment and the liquid compartment is a moulded baffle means 12 disposed above the maximum level of the liquid washing agent, which is represented by the dashed areas, in FIGS. 2 and 4.

Figure 3:
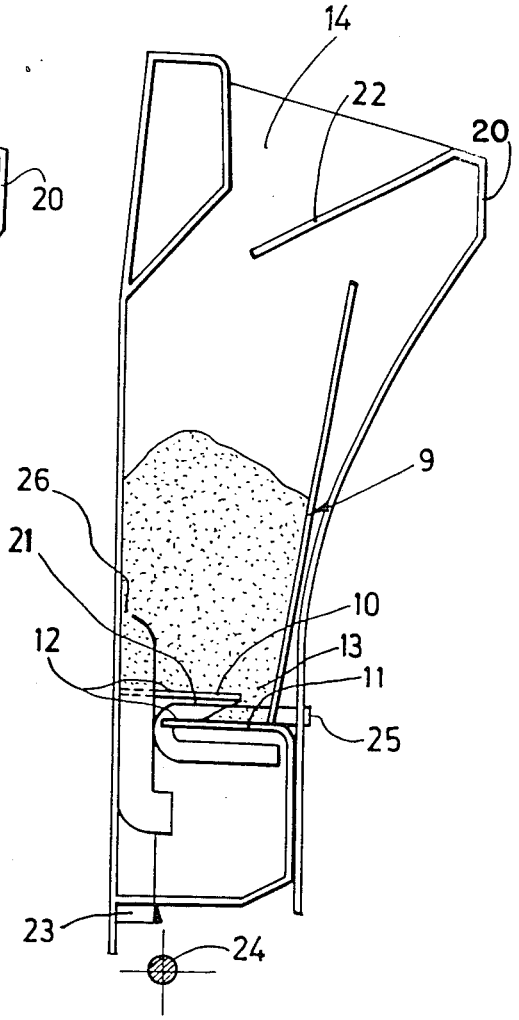
FIG. 3 is a longitudinal sectional view of the washing-agent dispenser filled with a washing powder in the vertical position.

The baffle means 12 comprises two substantially parallel baffle plates 10 and 11 which are in a horizontal position in FIGS. 2 and 3 and extend transversely of the dispenser. The substantially quadrilateral baffle plates of the baffle means are connected to three vertical walls of the dispenser at three sides, thus leaving a passage 13 and a passage 19 opposite each other, so that with the two baffle plates a duct 21 is formed between the powder compartment 9 and the liquid compartment 8 for discharging the liquid washing agent. If a user fills the machine with a liquid washing agent, the latter is poured into the powder compartment 9 through a common filling aperture 14 and flows through the baffle means 12 via the duct 21 to fill the liquid compartment 8.

FIG. 3 shows the dispenser filled with a washing powder, the door of the machine being in the open position. When a user wishes to use a washing powder, the latter is poured into the powder compartment 9 via the aperture 14. In the lower part of the compartment 9 the baffle means 12 retains the washing powder, represented by the dotted areas in FIGS. 3 and 5. Between the two baffle plates 10 and 11 the slope of the powder just behind the washing passage 13 in the duct 21 is indicated.

Figure 4:
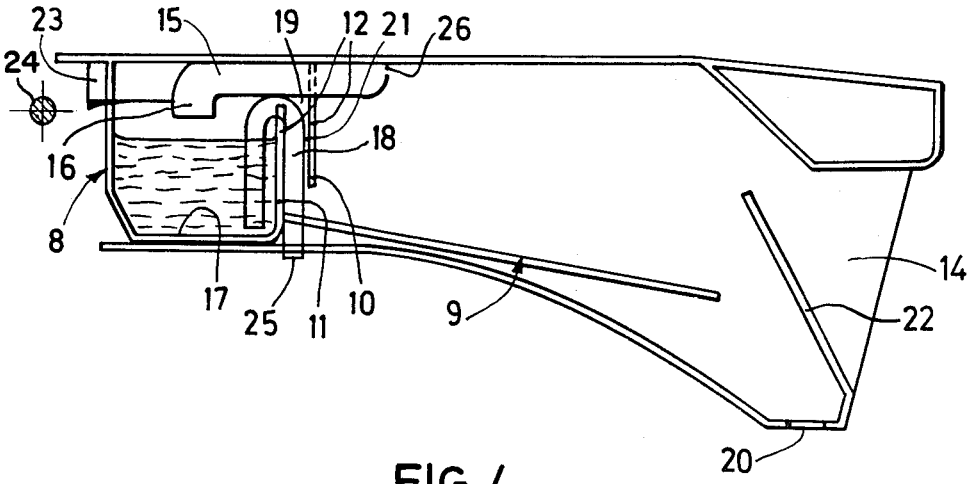
FIG. 4 shows the dispenser of FIG. 2 in the swung-down horizontal position.

FIG. 4 shows the dispenser filled with a liquid washing agent while the door is in a horizontal position. One of the baffle plates of the baffle means 12, i.e. the plate 11, which is then in a vertical position, constitutes an imperforate wall of the liquid compartment 8. A water-supply conduit 15 for the dispenser comprises a tube which has the shape of part of a torus, which is integral with the door, and which is arranged above the baffle plates 10 and 11. At one end the tube has a widened portion 23 which receives a water jet issuing from a nozzle connected to the chassis (not shown in FIG. 1) of the machine and at its other end it has an outlet 16 which is arranged above the liquid compartment and whose discharge axis is perpendicular to the wall 17 of this compartment, which wall in the position of FIG. 4 constitutes the substantially horizontal bottom of the liquid compartment. The part of the conduit 15 above the powder compartment 9 is formed with a number of small apertures 26 to form a shower for wetting the walls of the powder compartment.

A siphon 18 extends along a wall of liquid compartment 8 and provides communication between the liquid compartment and the interior of the tub, the end portion 25 of the siphon extending beyond the dispenser wall, which is the bottom wall in the position of FIG. 4.

In the lower part of the dispenser in the powder compartment a discharge aperture or opening 20 is formed, which aperture is situated near the common filling aperture 14 and is shielded by a deflector 22 preventing direct discharge of washing agents into the tub during filling.

For distributing the liquid washing agent a water-supply means injects water into the conduit 15. The outlet 16 directs the water jet towards the compartment wall 17 which breaks the jet to produce turbulence and emulsification of the liquid washing agent. The emulsion flows over the baffle plate 11 of the baffle means 12, into the duct 21, then into the powder compartment and finally into the tub via the discharge aperture 20 of the powder compartment. Residual water contained in the liquid compartment after discharge of the liquid washing agent is discharged into the machine tub via the siphon 18. For a satisfactory discharge of the liquid washing agent it is not necessary to use a siphon, because all the liquid washing agent is entrained by the water. However, for subsequent filling the liquid compartment should be free of residual water accumulated during the preceding washing cycle.

Figure 5:
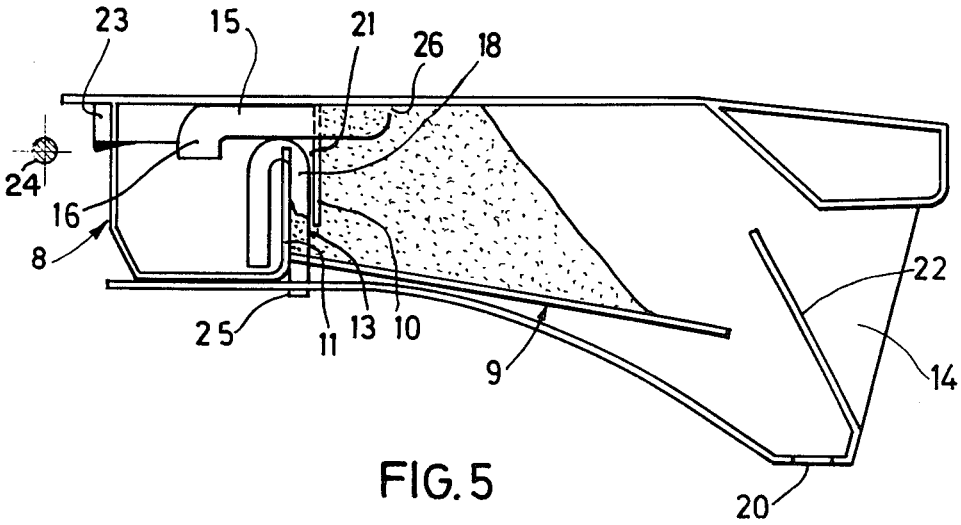
FIG. 5 shows the dispenser of FIG. 3 in the swung-down horizontal position.

FIG. 5 shows the dispenser filled with a washing powder, the door being shown in the horizontal position. The baffle plate 11 then forms a vertical imperforate wall for the powder compartment.

For distributing the washing powder the same water-supply means injects water into the conduit 15, which fills the liquid compartment 8 via its outlet 16. The water flows over the baffle plate 11, into the duct 21 and via the passage 13 it reaches the lower part of the powder compartment 9. The water flows into the compartment as a broad stream to carry the dissolved washing powder towards the discharge aperture 20 which communicates with the tub. At the same time the shower formed by the aperture 26 in the watersupply conduit 15 wets the walls of the powder compartment and rinses this compartment when most of the dissolved washing powder has been discharged into the tub. The siphon 18 drains residual water contained in the liquid compartment after the washing powder has been discharged into the tub and the water supply is stopped.

Figure 6:
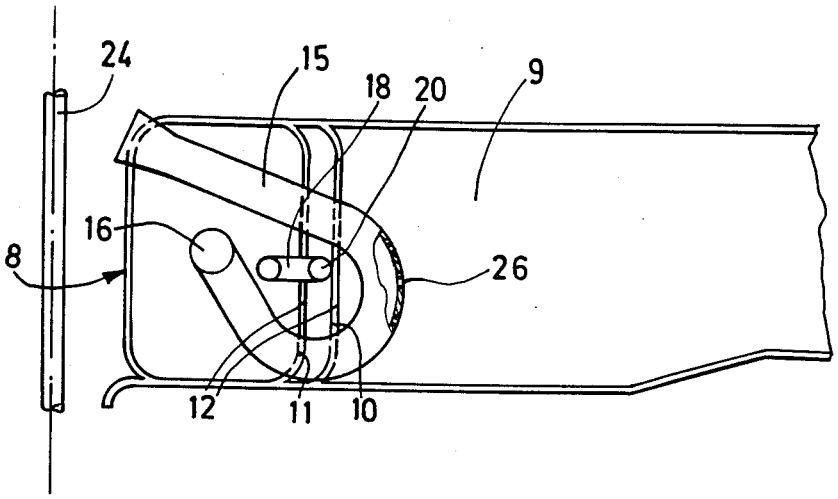
FIG. 6 is an underneath view showing part of the washing-agent dispenser with the tub door in the closed position.

FIG. 6 shows the dispenser in an underneath view. The conduit 18 which forms the siphon is arranged in such a way that liquid washing agent cannot flow into the interior of the tub via such conduit when the door is in the open position.

What is claimed is:

1. A top-loading washing machine, having a top and bottom wall and sidewalls defining a tub housing, which comprises a tub door formed in the top wall of the machine and pivotal between a vertical open position and a horizontal closed position; a longitudinally extending washing agent dispenser provided in the tub door, said dispenser having inner and outer walls connected to end walls and an aperture at one end of the introduction thereinto of either a liquid washing agent or a washing powder when the tub door is in its vertical position; a liquid compartment positioned at the opposite end of the dispenser and separated from an adjacent powder compartment by a partition, the partition being provided with openings for the passage into the liquid compartment of liquid washing agent introduced into the dispenser and being formed to retain washing powder introduced into the dispenser; an opening located in the inner wall of the dispenser adjacent the washing agent introduction aperture for dispensing of washing powder or liquid washing agent into the washing machine tub when the tub door is in its horizontal position; and a conduit for supplying water under pressure into the liquid compartment for mixing with any liquid washing agent therein or for entraining any washing powder in the powder compartment for dispensing the same in the horizontal position of the tub door.

2. A washing machine according to claim 1, in which the partition includes a first baffle plate extending from the inner dispenser wall toward the outer wall of the dispenser and forming a passageway with the outer dispenser wall; and a second baffle plate spaced from the first baffle plate and extending from the outer dispenser wall toward the inner dispenser wall and forming a passageway with the inner dispenser wall.

3. A washing machine according to claim 2, which includes a siphon disposed with respect to the first baffle plate for removing liquid from the liquid compartment and discharging the same into the washing machine tub.

4. A washing machine according to claim 1, which includes a deflector disposed in the powder compartment for deflecting introduced liquid washing agent or washing powder away from the dispenser inner wall opening.

* * * * *

UNITED STATES PATENT AND TRADEMARK OFFICE

CERTIFICATE OF CORRECTION

PATENT NO. : 4,759,202

DATED : July 26, 1988

INVENTOR(S) : EDITH CARON

It is certified that error appears in the above-identified patent and that said Letters Patent is hereby corrected as shown below:

At col. 4, claim 1, line 66, change "of" to --for--.

Signed and Sealed this

Seventeenth Day of January, 1989

*Attest:*

DONALD J. QUIGG

*Attesting Officer*

*Commissioner of Patents and Trademarks*